US010602854B2

(12) United States Patent
Gu et al.

(10) Patent No.: US 10,602,854 B2
(45) Date of Patent: Mar. 31, 2020

(54) METHOD AND SYSTEM FOR FOOTREST STRETCHING DEVICE FOR CONVERTIBLE SOFA SEATING UNIT

(71) Applicant: ZHEJIANG FEILI TECHNOLOGY CO., LTD., Zhejiang (CN)

(72) Inventors: Weijie Gu, Zhejiang (CN); Guoli Zou, Zhejiang (CN); Dai Mingxing, Zhejiang (CN)

(73) Assignee: ZHEJIANG FEILI TECHNOLOGY CO., LTD., Zhejiang (CN)

( * ) Notice: Subject to any disclaimer, the term of this patent is extended or adjusted under 35 U.S.C. 154(b) by 83 days.

(21) Appl. No.: 15/887,540

(22) Filed: Feb. 2, 2018

(65) Prior Publication Data

US 2019/0038039 A1 Feb. 7, 2019

(30) Foreign Application Priority Data

Aug. 3, 2017 (CN) ..... 2017 1 0654319

(51) Int. Cl.
*A47C 1/034* (2006.01)
*A47C 7/50* (2006.01)
(Continued)

(52) U.S. Cl.
CPC ..... *A47C 20/021* (2013.01); *A47C 1/0355* (2013.01); *A47C 7/506* (2013.01);
(Continued)

(58) Field of Classification Search
CPC ... A47C 1/0355; A47C 1/0347; A47C 3/0255; A47C 7/506; A47C 1/024; A47C 7/503; A47C 7/5068
See application file for complete search history.

(56) References Cited

U.S. PATENT DOCUMENTS 4,544,201 A * 10/1985 Rogers, Jr. ..... A47C 1/0355 297/259.2
5,354,116 A * 10/1994 May ..... A47C 1/0347 297/423.34

(Continued)

FOREIGN PATENT DOCUMENTS

DE 3524056 A1 1/1987

*Primary Examiner* — Shin H Kim
(74) *Attorney, Agent, or Firm* — Marshall, Gerstein & Borun LLP

(57) ABSTRACT

A footrest stretching device used for a convertible sofa including a left-side component and a right-side component; the left-side component and the right-side component are each provided with identical parts as follows: a mounting side-plate, a third foot lever and a fourth foot lever, with one end of the third foot lever and one end of the fourth foot lever being rotatably connected to the mounting side-plate; the footrest stretching device includes a first footrest connector connected to the other end of the third foot lever, and a second footrest connector connected to the other end of the fourth foot lever; an outer footrest mounting member is connected to the other end of the first footrest connector; a middle footrest mounting member is connected to the other end of the second footrest connector; a third footrest connector is rotatably connected onto the second footrest connector; a fourth footrest connector is connected onto the third footrest connector; an inner footrest mounting member is rotatably connected to the other end of the fourth footrest connector.

8 Claims, 10 Drawing Sheets

(51) Int. Cl.

| | |
|---|---|
| ***A47C 20/08*** | (2006.01) |
| ***A47C 20/00*** | (2006.01) |
| ***A47C 17/16*** | (2006.01) |
| ***A47C 1/0355*** | (2013.01) |
| ***A47C 7/52*** | (2006.01) |

(52) U.S. Cl.
CPC ..... *A47C 7/52* (2013.01); *A47C 17/163* (2013.01); *A47C 17/162* (2013.01)

(56) References Cited

U.S. PATENT DOCUMENTS 5,795,021 A * 8/1998 Rogers ..... A47C 3/0255 297/259.2
5,800,010 A * 9/1998 May ..... A47C 1/0355 297/84
6,540,291 B2 * 4/2003 Hoffman ..... A47C 1/03255 297/84
7,762,625 B2 * 7/2010 Hoffman ..... A47C 1/0355 297/423.26
8,911,009 B2 * 12/2014 Hoffman ..... A47C 1/03266 297/75
9,326,615 B1 * 5/2016 LaPointe ..... A47C 7/5068
9,386,857 B2 * 7/2016 Lawson ..... A47C 1/032
9,433,294 B2 * 9/2016 Donovan ..... A47C 1/0242
9,433,295 B2 * 9/2016 Crum ..... A47C 1/03211
9,844,269 B2 * 12/2017 Bryant ..... A47C 1/034
9,845,852 B2 * 12/2017 Lawson ..... F16H 25/20
9,962,004 B2 * 5/2018 Bryant ..... A47C 1/022
10,104,966 B2 * 10/2018 Lawson ..... A47C 1/0342
10,299,596 B2 * 5/2019 White ..... A47C 1/0352
2012/0146364 A1 * 6/2012 Hoffman ..... A47C 1/03266 297/84
2012/0299363 A1 * 11/2012 Crum ..... A47C 1/0355 297/85 M
2014/0049084 A1 * 2/2014 Lawson ..... A47C 1/032 297/340
2015/0054315 A1 * 2/2015 Donovan ..... A47C 1/0242 297/68
2015/0108812 A1 * 4/2015 Huang ..... A47C 1/0355 297/354.12
2015/0272335 A1 * 10/2015 Lawson ..... A47C 7/506 297/423.19
2016/0029800 A1 * 2/2016 Bryant ..... A47C 1/034 297/284.3
2016/0273632 A1 * 9/2016 Lawson ..... F16H 25/20
2018/0027965 A1 * 2/2018 Lawson ..... A47C 1/0342
2018/0103761 A1 * 4/2018 White ..... A47C 1/0352
2018/0242740 A1 * 8/2018 Lawson ..... A47C 1/024
2019/0038039 A1 * 2/2019 Gu ..... A47C 20/021
2019/0116978 A1 * 4/2019 Jorbel ..... A47C 1/0352

* cited by examiner

METHOD AND SYSTEM FOR FOOTREST STRETCHING DEVICE FOR CONVERTIBLE SOFA SEATING UNIT

CROSS-REFERENCE TO RELATED APPLICATIONS

This application claims priority under 35 USC § 119 to Chinese patent application No. 201710654319.X, filed Aug. 3, 2017, the entirety of which is hereby incorporated by reference.

FIELD OF THE DISCLOSURE

The present disclosure pertains to the technical field of sofas, and relates to a convertible sofa, in particular to a footrest stretching device for a convertible sofa.

BACKGROUND

A sofa is a well-known type of soft cushioned chair, and in people's daily life, upholstered or leather sofas have become very popular furniture relative to antique wooden chairs, as existing cloth-or leather-sofas can provide more comfort for users. With continuous improvement of people's living standards, the demand for sofas is also increasing, while the demand for ordinary, single-function sofas seems to be diminishing.

Existing articulating features for sofas include backrest tilting-and-resetting and footrest expanding-and-retracting. In order to make the adjustment of the backrest and footrest of the sofa more flexible, the backrest and footrest of the sofa may be controlled individually, to accommodate different rest positions of users. In existing sofas, a footrest is relatively simply designed and generally consists of only one plate with a fixed area. When users of different ages or heights sit on such a sofa, a problem may occur in that children or even adult users having relatively short height find that their feet cannot reach the footrest; and a problem may also occur to users who are relatively tall, in that their feet cannot comfortably rest on the footrest without hanging over the lower edge.

Therefore, to those skilled in the art, there is still a need to improve the footrest of an existing sofa, to solve the above problems, so that the supporting surface of the footrest of the sofa can be adapted to the users of different ages and different heights, so as to obtain a larger consumer market for manufacturers.

SUMMARY

In view of the above problems in the prior art, the object of the present disclosure is to provide a footrest stretching device for a convertible sofa, which can adjust the supporting surface area of the footrest.

The object of the present disclosure can be achieved by the following technical schemes: a footrest stretching device for a convertible sofa including a left-side component and a right-side component, the left-side component and the right-side component being fixedly connected by a fixing member and each provided with identical parts as follows: a mounting side-plate, a third foot lever and a fourth foot lever, with one end of the third foot lever and one end of the fourth foot lever being rotatably connected to the mounting side-plate, the footrest stretching device including: A first footrest connector connected to the other end of the third foot lever, and a second footrest connector connected to the other end of the fourth foot lever; an outer footrest mounting member is connected to the other end of the first footrest connector; a middle footrest mounting member is connected to the other end of the second footrest connector; a third footrest connector is rotatably connected onto the second footrest connector; the other end of the third footrest connector is rotatably connected to the outer footrest mounting member by a footrest support member; a fourth footrest connector is connected onto the third footrest connector; an inner footrest mounting member is rotatably connected to the other end of the fourth footrest connector; the middle footrest mounting member is provided with a sliding slot; the outer footrest mounting member has a sliding post fixed thereon; the sliding post is disposed in the sliding slot and can slide along the sliding slot; a middle footrest is detachably connected onto the middle footrest mounting member; an inner footrest is detachably connected onto the inner footrest mounting member; an outer footrest is detachably connected onto the outer footrest mounting member.

In the footrest stretching device for a convertible sofa provided by the present invention, the footrest has three plates: the middle footrest, the inner footrest and the outer footrest. Under the action of an external force, the third foot lever and the fourth foot lever rotate, and correspondingly, the first footrest connector and the second footrest connector start their motion; under the action of the third footrest connector and the footrest support member, the outer footrest mounting member and the middle footrest mounting member are separated from each other, so that the middle footrest and the outer footrest move relative to each other and thus are separated; in the meantime, under the action of the third footrest connector and the fourth footrest connector, the inner footrest mounting member and the middle footrest mounting member are separated from each other, so that the middle footrest and the inner footrest move relative to each other and thus are separated; the middle footrest, the outer footrest and the inner footrest are separated, thus making the footrest area of the sofa become larger, thereby facilitating a user resting his feet.

In the above-described footrest stretching device for a convertible sofa, the other end of the third foot lever and the first footrest connector are rotatably connected through a first rotating shaft; the other end of the fourth foot lever and the second footrest connector are rotatably connected through a second rotating shaft; the other end of the first footrest connector and the outer footrest mounting member are rotatably connected through a third rotating shaft; the other end of the second footrest connector and the middle footrest mounting member are rotatably connected through a fourth rotating shaft; the second footrest connector and one end of the third footrest connector are rotatably connected through a fifth rotating shaft; the other end of the third footrest connector and one end of the footrest support member are rotatably connected through a sixth rotating shaft; the other end of the footrest support member and the outer footrest mounting member are rotatably connected through a seventh rotating shaft; an intermediate portion of the third footrest connector and one end of the fourth footrest connector are rotatably connected through an eighth rotating shaft; the other end of the fourth footrest connector and the inner footrest mounting member are rotatably connected through a ninth rotating shaft.

In the above-described footrest stretching device for a convertible sofa, the first footrest connector has a protrusion fixed thereon and protruding relative to the surface thereof; the fourth footrest connector has a limiting slot provided thereon; the protrusion can move back and forth in the limiting slot. The fourth footrest connector can move along with the movement of the first footrest connector, so that the fourth footrest connector will not disengage from the first footrest connector, thus ensuring the mutual movement between the inner footrest mounting member and the outer footrest mounting member.

In the above-described footrest stretching device for a convertible sofa, a footrest protector is detachably fixed onto the middle footrest mounting member. Under the effect of the footrest protector, a user can be protected from his clothing at his feet getting stuck.

In the above-described footrest stretching device for a convertible sofa, the footrest protector is made of a plastic material.

In the above-described footrest stretching device for a convertible sofa, the middle footrest mounting member has thereon a first fixing portion perpendicular to the surface thereof; the first fixing portion is provided thereon with a plurality of first mounting holes in an elongated shape; the middle footrest is provided thereon with a plurality of first connecting holes corresponding to the first mounting holes; the first mounting hole and the corresponding first connecting hole are connected by a first bolt therethrough.

In the above-described footrest stretching device for a convertible sofa, the outer footrest mounting member has thereon a second fixing portion perpendicular to the surface thereof; the second fixing portion is provided thereon with a plurality of second mounting holes in an elongated shape and third mounting holes in a circular shape; the outer footrest is provided thereon with a plurality of second connecting holes corresponding to the second mounting holes and third connecting holes corresponding to the third mounting holes; the second mounting hole and the corresponding second connecting hole are connected by a second bolt therethrough; the third mounting hole and the corresponding third connecting hole are connected by a third bolt therethrough.

In the above-described footrest stretching device for a convertible sofa, the inner footrest mounting member has thereon a fourth fixing portion perpendicular to the surface thereof; the fourth fixing portion is provided thereon with a plurality of fourth mounting holes in a circular shape; the inner footrest is provided thereon with a plurality of fourth connecting holes corresponding to the fourth mounting holes; the fourth mounting hole and the corresponding fourth connecting hole are connected through a fourth bolt in them.

Compared with the prior art, the footrest stretching device for a convertible sofa provided by the present invention has the following advantages:

Advantage 1. In the present disclosure, the footrest includes three plates: the middle footrest, the inner footrest and the outer footrest; middle footrest, the inner footrest and the outer footrest being movable relative to one another during actuation of the convertible sofa so as to be separated varying distances from one another, thus making the footrest area of the sofa become larger, thereby facilitating a user resting his feet.

Advantage 2. A footrest protector is detachably fixed onto the middle footrest mounting member, and thus a user can be protected from his clothing at his feet getting stuck.

Advantage 3. The present disclosure has a relatively simple structure, and can be widely used in single-, double-, or three-seat sofas.

Advantage 4. One of the fundamental problems that manufacturers of sofas with a recliner mechanism and footrest ottomans are trying to solve is how to maximize the area covered by the footrest, or footrests, when the recliner mechanism is fully extended while at the same time minimizing the area or the space covered by the same footrest or footrests when the footrest(s) are hidden under the sofa when the recliner mechanism is fully retracted. This area is best indicated by measuring the distance between the outer edge of the outer most footrest to the outer edge of the inner most footrest.

This distance, as described above, when the recliner mechanism is fully extended determines how much space the footrest(s) provide to the person using the sofa. The bigger the area covered by the footrest(s), when the recliner mechanism is fully extended, the more comfortable it will be for the user of the sofa and thus this makes the product more desirable to the user. However, the less area covered by the footrest(s) when the recliner mechanism is fully retracted the better the mechanism can be hidden under the sofa and the less space will be required under the sofa in order to store the footrest(s), and the recliner mechanism as well, when the recliner mechanism is fully retracted. This is important from design, comfort, functionality and manufacturability points of view.

Consequently, based on what is indicated above, the ratio of the area covered by the footrest(s) during full extension of the recliner mechanism to the area covered by the footrest(s) during the full retraction of the recliner mechanism is an important measure of how well the sofa functions and how much comfort the user receives from the product. The larger this ratio, the more desirable the product will be from design, comfort, functionality and manufacturability points of view.

Since the lengths and the widths of each individual footrest are all constant parameters, the key ratio is the ratio of the total expanded width (TW1 in FIG. 1) of the three footrests and the gaps between them when in the fully extended position of the recliner mechanism, to the total width (TW2 in FIG. 3) of the three footrests and the gaps between them when in the fully retracted position of the recline mechanism. Herein this ratio is referred to as the ratio of expansion, or simply as the ratio.

Since the widths of the footrest(s) are generally constant, and also the widths of each individual footrest is also constant, the main variables are the separation gaps or the distance between one footrest from the adjacent footrest. In a design in which there exist three separate footrests there will be two such gaps. The first gap is the distance between the outer footrest and the middle footrest and the second gap is the distance between the middle footrest and the inner footrest. In a theoretically optimum scenario the combined distances of these two gaps should be zero when the recliner mechanism is fully retracted. In other words, it is desirable to have the three footrests packed very tightly together in the space under the sofa in order to minimize the space required to store them during the full retraction of the recliner mechanism. Similarly one would desire to have these gaps be as wide as possible when the footrest(s) are out and are fully stretched during the full extension of the recliner mechanism. This is because a larger gap between two adjacent footrests translates into more area for the user to more comfortably put their feet and legs on the footrest(s).

Mechanically, in order to achieve the above desired effect of maximizing the gaps between the adjacent footrests during full extension of the recliner mechanism, the best design is one that allows each footrest to be moved individually. This translates into the gap between each two adjacent footrests to be varied individually. In other words, in the example of a three footrests design where there are two gaps between the adjacent pairs of footrests, each gap is maximized during the full extension of the recliner mechanism and minimized during the full retraction of the recliner mechanism. In the current disclosure this effect is achieved through a novel linkage mechanism that is capable of varying each individual gaps between each pair of adjacent footrests and consequently maximize the above described ratio of expansion.

Figure 1:
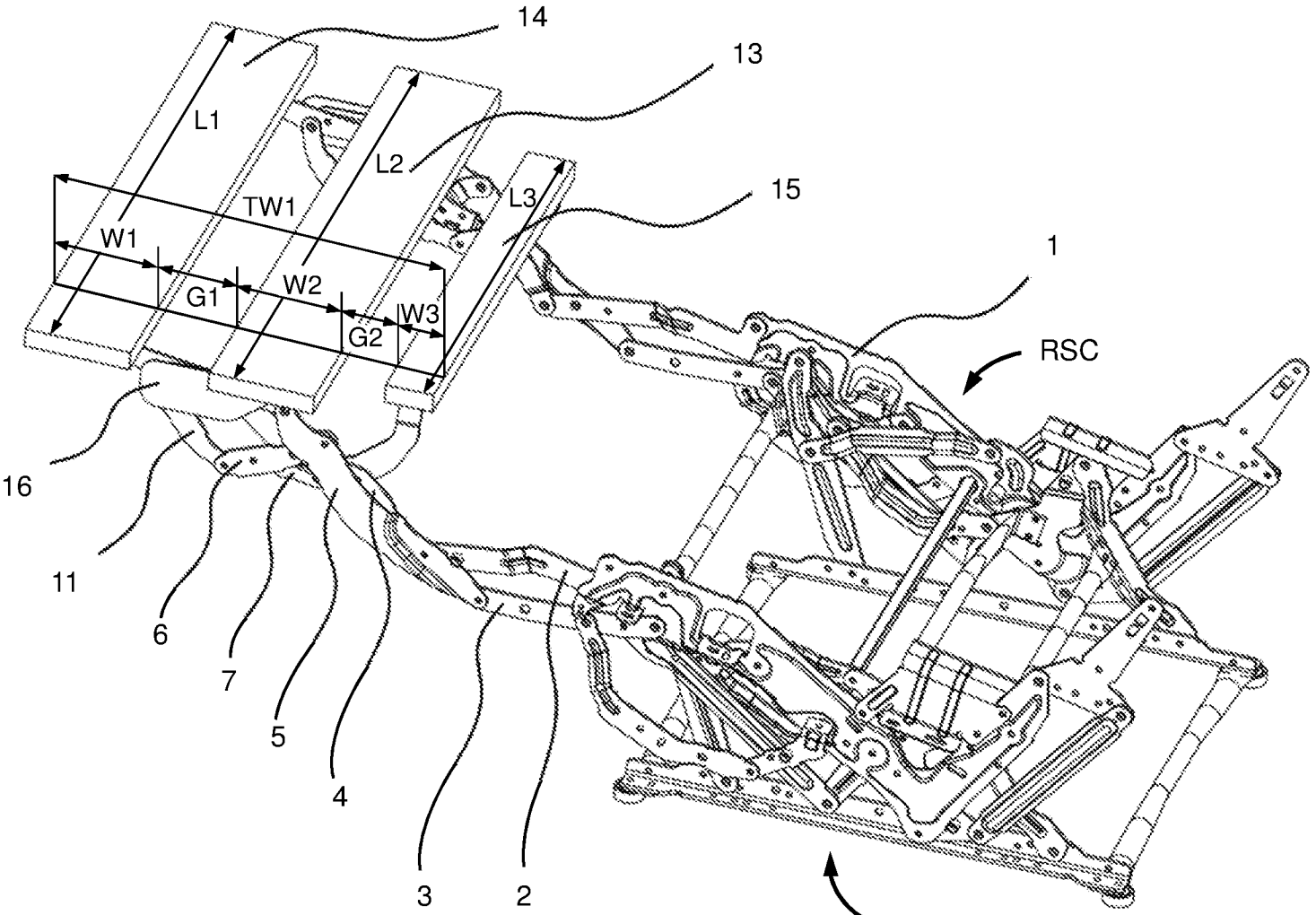
FIG. 1 is a perspective view of the stretching device for an articulating sofa section with the three footrests depicted.

In the drawings the components and the corresponding numerical indicator of the components are as follows, with the numerical indicator listed first and then the name of the component:

RSC Right-side component
LSC Left-side component
1. mounting side-plate;
2. third foot lever;
3. fourth foot lever;
4. first footrest connector;
5. second footrest connector;
6. third footrest connector;
7. fourth footrest connector;
8. middle footrest mounting member;
9. outer footrest mounting member;
10. inner footrest mounting member;
11. footrest support member;
12. sliding slot;
13. middle footrest;
14. outer footrest;
15. inner footrest;
16. footrest protector;
17. protrusion;
18. limiting slot;
21. front linkage member;
22. third link rod;
23. rear linkage member;
24. fourth link rod;
25. protective member;
26. backrest member;
27. linkage member;
28. torsion tube;
29. bottom foot;
31A. front stabilizing tube;
31 B. rear stabilizing tube;
32. bottom connecting tube;
33. rear support member;
34. first link rod;
35. A rotating-shaft transmission member;
36. front support member;
37. sixth link rod;
38. fifth link rod;
39. rotating square tube.

DETAILED DESCRIPTION

Hereinafter, the technical solutions of the present invention will be further described in connection with the specific embodiments of the present invention given below with reference to the accompanying drawings; however, the present invention is not limited to these embodiments.

Figure 2:
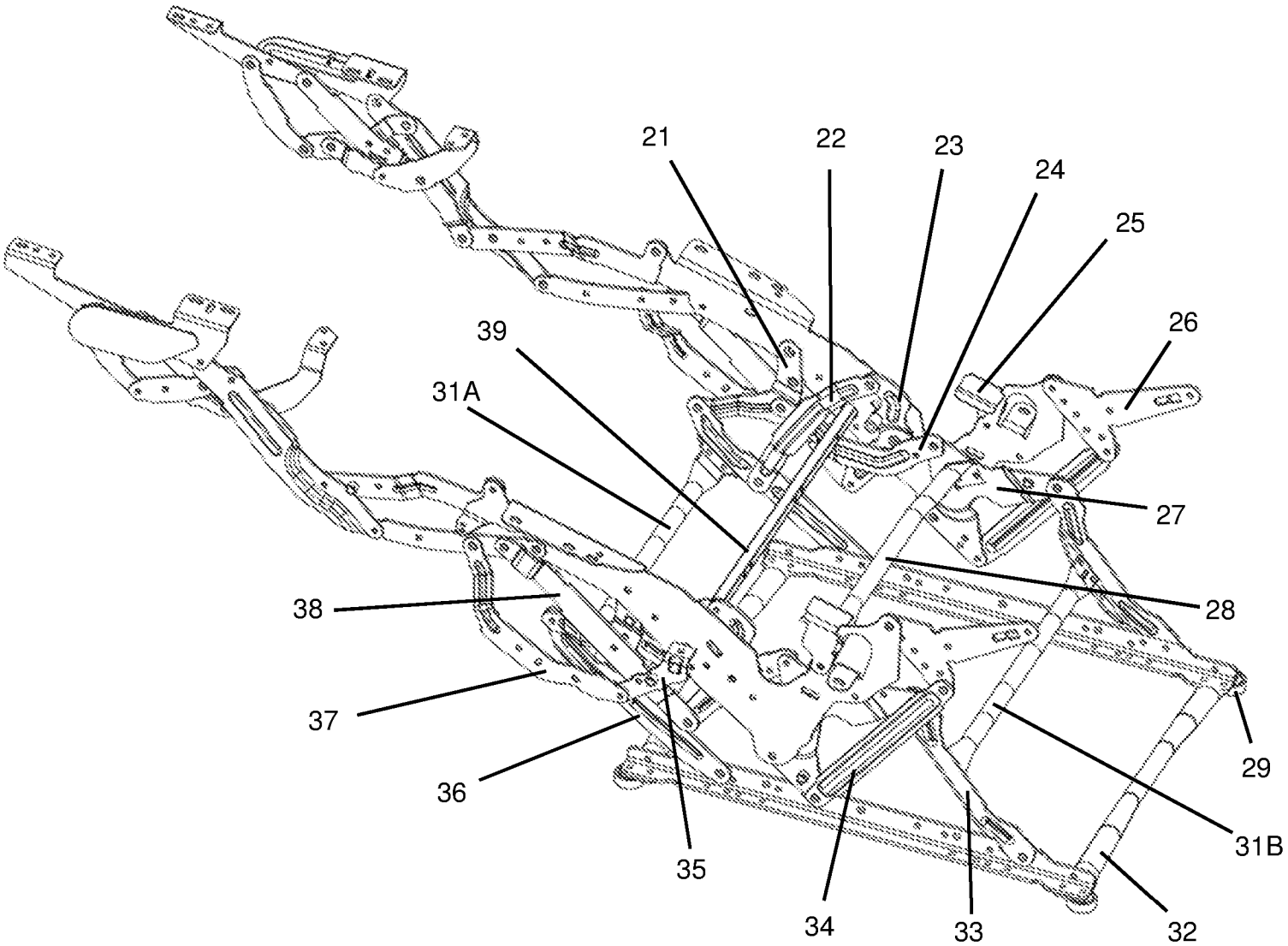
FIG. 2 is a perspective view of the stretching device for an articulating sofa section without the three footrests depicted.

FIGS. 1 and 2 illustrate a stretching device for an articulating section of a convertible sofa, which includes a left-side component and a right-side component, the left-side component and the right-side component being fixedly connected by a fixing member and each provided with identical parts as follows: a third foot lever 2, a fourth foot lever 3, a mounting side-plate 1, a first link rod 34, a front linkage member 21, a fourth link rod 24, a sixth link rod 37, a rear support member 33, a front support member 36, a linkage member 27, a rear linkage member 23, a rotating-shaft transmission member 35, a backrest member 26, a bottom foot 29, a protective member 25, a third link rod 22, and a fifth link rod 38. One end of the third foot lever 2 is rotatably connected to the mounting side-plate 1; one end of the fourth foot lever 3 is rotatably connected to the mounting side-plate 1; the fourth foot lever 3 is also rotatably connected to the sixth link rod 37 and the fifth link rod 38; the sixth link rod 37 is rotatably connected to the rotating-shaft transmission member 35; the mounting side-plate 1 is rotatably connected to the fourth foot lever 3, the third foot lever 2, the rear linkage member 23, the backrest member 26 and the front linkage member 21; the front linkage member 21 is rotatably connected to the fourth link rod 24 and the front support member 36; the front support member 36 is rotatably connected to the third link rod 22 and the bottom foot 29; the rear linkage member 23 is rotatably connected to the third link rod 22, the mounting side-plate 1 and the fifth link rod 38; the linkage member 27 is rotatably connected to the fourth link rod 24, the rear support member 33, the first link rod 34 and the mounting side-plate 1; the first link rod 34 is rotatably connected to the backrest member 26; the protective member 25 is fixedly connected to the mounting side-plate 1.

Specifically, the connectors includes: a rotating square tube 39, a bottom connecting tube 32, a front stabilizing tube 31A, a rear stabilizing tube 31 B and a torsion tube 28; the front stabilizing tube 31A is fixedly connected to the front support members 36 of both the left-side component LSC and the right-side component RSC; the rear stabilizing tube 31 B is fixedly connected to the rear support members 33 of both the left-side component LSC and the right-side component RSC; the torsion tube 28 is fixedly connected to the linkage members 27 of both the left-side component LSC and the right-side component RSC; the rotating square tube 39 is fixedly connected to the rotating-shaft transmission members 35 of both the left-side component LSC and the right-side component RSC; the bottom connecting tube 32 is fixedly connected to the bottom feet 29 of both the left-side component LSC and the right-side component RSC, respectively; the above-mentioned tubes in the connectors are all fixedly connected by bolts.

As described earlier in this disclosure, one of the fundamental problems that manufacturers of sofas with a recliner mechanism and footrest ottomans are trying to solve is how to maximize the area covered by the footrest, or footrests, when the recliner mechanism is fully extended, while at the same time minimizing the area or the space covered by the same footrest or footrests when the footrest(s) are hidden under the sofa when the recliner mechanism is fully retracted. This area is best indicated by measuring the distance between the outer edge of the outer-most footrest to the outer edge of the inner-most footrest. In FIG. 1 this distance is indicated by TW1.

This distance TW1 in FIG. 1, as described above, when the recliner mechanism is fully extended determines how much space the footrest(s) provide to the person using the sofa. The bigger the area covered by the footrest(s), when the recliner mechanism is fully extended, the more comfortable it will be for the user of the sofa (particularly if the user has relatively long legs) and thus this makes the product more desirable to the user. However, the less area covered by the footrest(s) when the recliner mechanism is fully retracted the better the mechanism can be hidden under the sofa and the less space will be required under the sofa in order to store the footrest(s), and the recliner mechanism as well, when the recliner mechanism is fully retracted. This is important from design, comfort, functionality and manufacturability points of view.

Consequently, based on what is indicated above, the ratio of the area covered by the footrest(s) during full extension of the recliner mechanism to the area covered by the footrest(s) during the full retraction of the recliner mechanism is an important measure of how well the sofa functions and how much comfort the user receives from the product. The larger this ratio is the more desirable the product will be from design, comfort, functionality and manufacturability points of view.

Referring to FIG. 1, since the widths of the footrest(s), which are indicated as W1, W2 and W3 are generally constant, and also the lengths L1, L2, and L3 of each individual footrest are also constant, the main variables to determining the range of effective total footrest surface area (including the three footrests and intermediate gaps therebetween) are the extent of the separation gaps (the distance between each footrest and the adjacent footrest). In a design in which there exist three separate footrests, there will be two such gaps which in the embodiments depicted in FIG. 1 are indicated by G1 and G2.

The first gap G1 is the distance between the outer footrest and the middle footrest and the second gap G2 is the distance between the middle footrest and the inner footrest as indicated in FIG. 1. In a theoretically optimum scenario the combined distances of these two gaps (G1+G2) should be zero when the recliner mechanism is fully retracted. In other words, it is desirable to have the three footrests packed very tightly together in the space under the sofa in order to minimize the space required to store them during the full retraction of the recliner mechanism. Similarly, one would desire to have these two gaps G1 and G2 be as wide as possible when the footrest(s) are out and are fully stretched during the full extension of the recliner mechanism. This is because a larger gap (G1 and/or G2) between two adjacent footrests translates into more effective area for the user to more comfortably spread out their feet and legs on the footrest(s).

Figure 3:
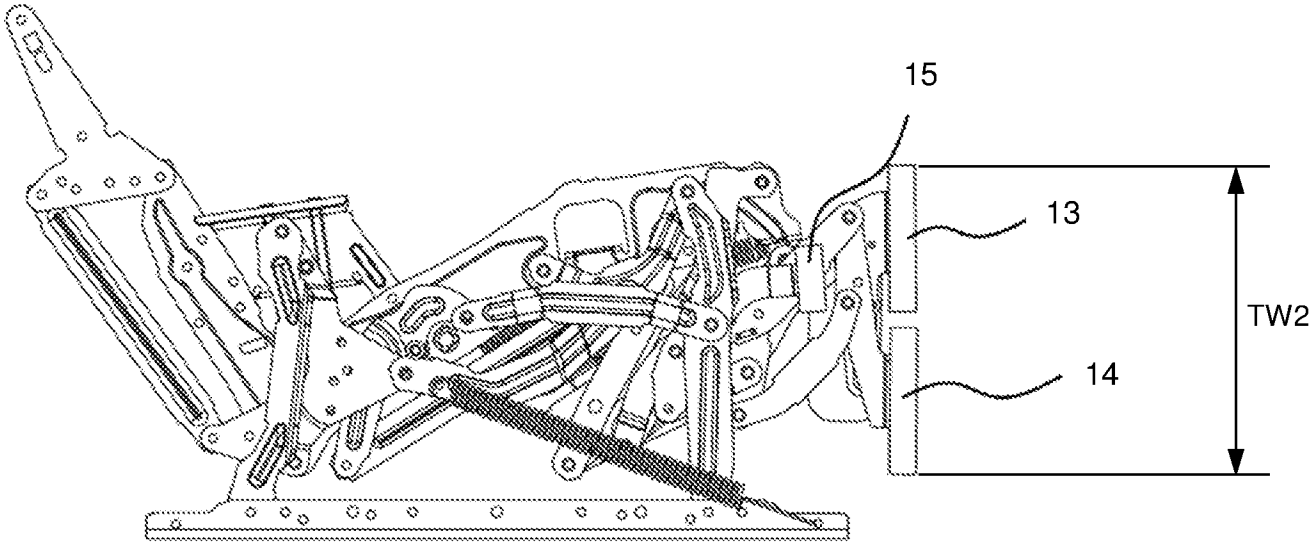
FIG. 3 is a right elevation view of the footrest of the stretching device of FIG. 1, in a fully retracted state.
Figure 4:
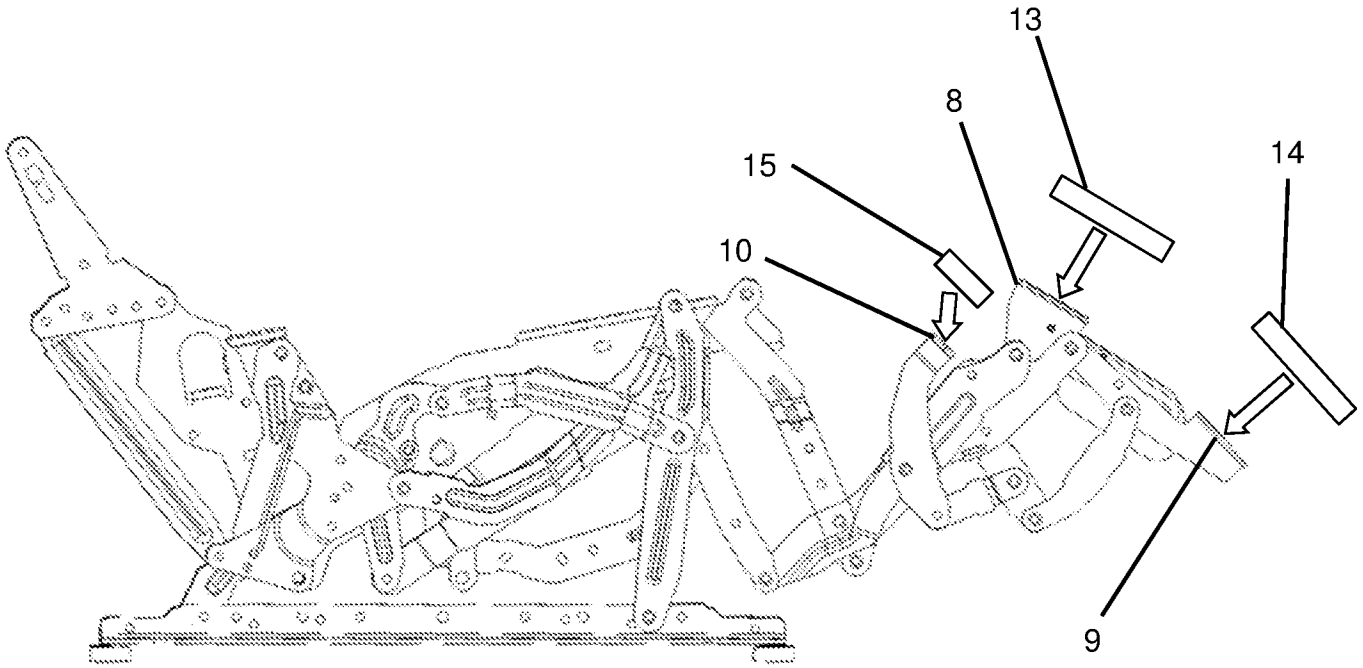
FIG. 4 is a right elevation view of the footrest of the stretching device of FIG. 1, in a partially stretched state.
Figure 5:
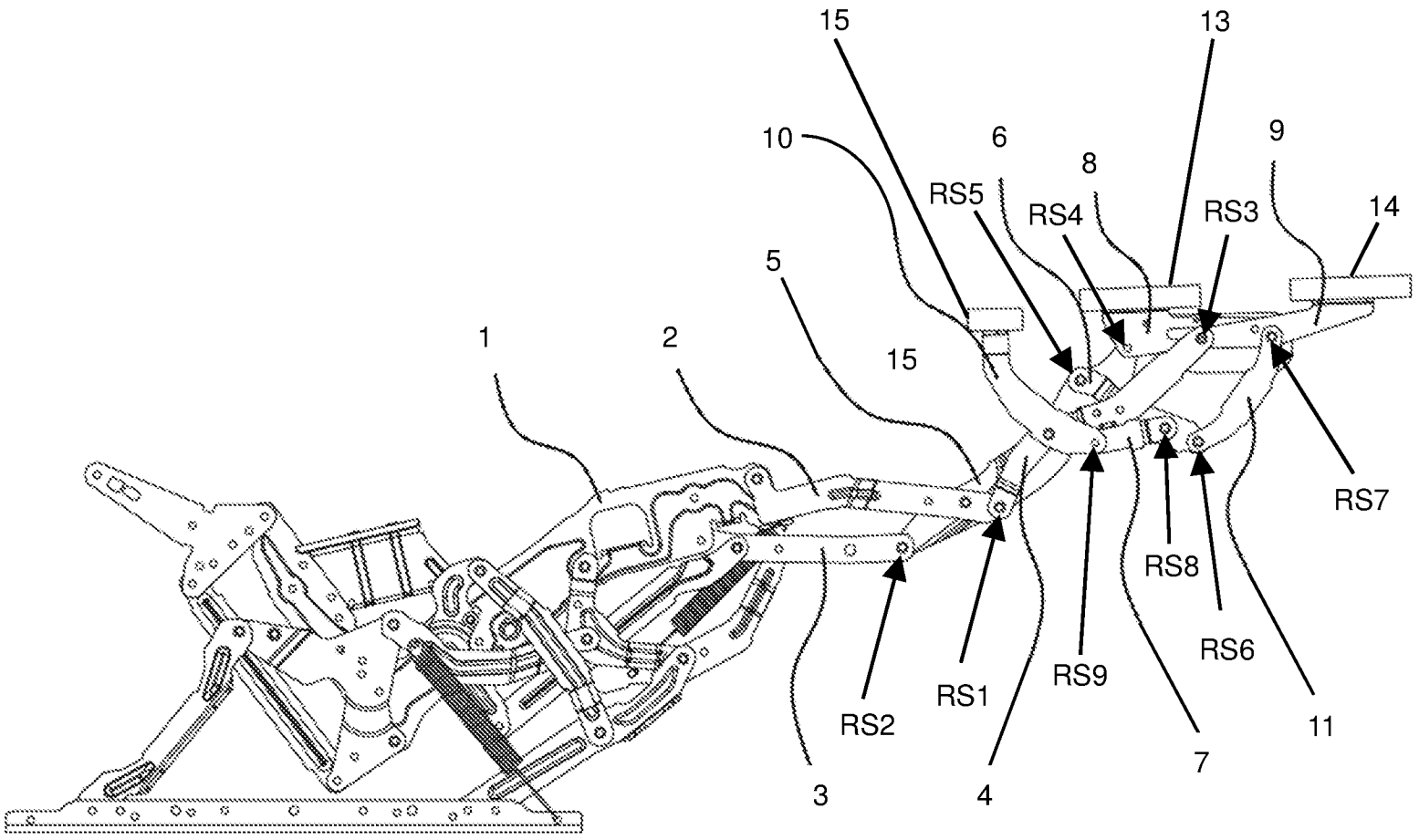
FIG. 5 is a right elevation view of the footrest of the stretching device of FIG. 1, in a fully stretched state.

Since the lengths of the footrests L1, L2 and L3 are constant then the effective footrest area is dependent on the total width (TW1=W1+G1+W2+G2+W3). In FIG. 1 this total width, in the case of the recliner mechanism being fully extended is indicated by TW1. In FIG. 3 this total width, in the case of the recliner mechanism being fully retracted is indicated by TW2. The ratio of expansion is the ratio of TW1 to TW2 or in other words TW1/TW2. It is desirable to maximize this ratio of expansion. The ability to have the inner footrest 15 automatically tucked behind one or both of the other footrests 13, 14 when the unit is in the un-reclined (retracted) position advantageously helps to increase the ratio of expansion, as the effective contribution of G2 and W3 to the overall width dimension in the un-reclined position is zero.

Mechanically, in order to achieve the above desired effect of maximizing the gaps G1 and G2 between the adjacent footrests during full extension of the recliner mechanism, and consequently maximizing the expansion ratio (TW2/TW1), an optimal design is one that allows each footrest to be moved individually with respect to one another. This permits the gap (G1 and/or G2) between each two adjacent footrests to be varied individually. In other words, in the example of a three footrest design where there are gaps between the adjacent footrests, each gap (G1 and/or G2) is maximized during the full extension of the recliner mechanism and minimized during the full retraction of the recliner mechanism. In the current disclosure this effect is achieved through a novel linkage mechanism that is capable of varying each individual gaps (G1 and/or G2) between each pair of adjacent footrests and consequently maximize the above described ratio of expansion. The outer footrest mounting member 9 is linked to the middle footrest mounting member 8 by a variable-length connection, such as by a pin-and-slot connection, that effectively permits the gap G1 to vary telescopingly during the movement of the unit from the retracted to the reclined position. Simultaneously, a pivoting, slidable connection between the inner footrest mounting member 10 and links that effect movement and support of the middle and outer footrest mounting members facilitates movement of the inner footrest 15 from the tucked position when the unit is in the un-reclined (retracted) condition to an extended position substantially aligned with the middle footrest 13 and outer footrest 14.

FIGS. 1-10 illustrate a footrest stretching device, and the associated components, for a convertible sofa. The footrest stretching device includes: a first footrest connector 4 connected to the other end of the third foot lever 2, and a second footrest connector 5 connected to the other end of the fourth foot lever 3; wherein an outer footrest mounting member 9 (see FIGS. 4, 5) is connected to the other end of the first footrest connector 4; a middle footrest mounting member 8 is connected to the other end of the second footrest connector 5; a third footrest connector 6 is rotatably connected onto the second footrest connector 5; the other end of the third footrest connector 6 is rotatably connected to the outer footrest mounting member 9 by a footrest support member 11; a fourth footrest connector 7 is connected onto the third footrest connector 6; an inner footrest mounting member 10 is rotatably connected to the other end of the fourth footrest connector 7. A middle footrest 13 is detachably connected onto the middle footrest mounting member 8; an inner footrest 15 is detachably connected onto the inner footrest mounting member 10; an outer footrest 14 is detachably connected onto the outer footrest mounting member 9. A footrest protector 16 is detachably fixed onto the middle footrest mounting member 8, and the footrest protector 16 is made of a plastic material. The middle footrest mounting member 8 is provided with a sliding slot 12; the outer footrest mounting member 9 has a sliding post fixed thereon; the sliding post is disposed in the sliding slot 12 and can slide along the sliding slot 12.

In this embodiment, the other end of the third foot lever 2 and the first footrest connector 4 are rotatably connected through a first rotating shaft RS1; the other end of the fourth foot lever 3 and the second footrest connector 5 are rotatably connected through a second rotating shaft RS2; the other end of the first footrest connector 4 and the outer footrest mounting member 9 are rotatably connected through a third rotating shaft RS3; the other end of the second footrest connector 5 and the middle footrest mounting member 8 are rotatably connected through a fourth rotating shaft RS4; the second footrest connector 5 and one end of the third footrest connector 6 are rotatably connected through a fifth rotating shaft RS5; the other end of the third footrest connector 6 and one end of the footrest support member 11 are rotatably connected through a sixth rotating shaft RS6; the other end of the footrest support member 11 and the outer footrest mounting member 9 are rotatably connected through a seventh rotating shaft RS7; an intermediate portion of the third footrest connector 6 and one end of the fourth footrest connector 7 are rotatably connected through an eighth rotating shaft RS8; the other end of the fourth footrest connector 7 and the inner footrest mounting member 10 are rotatably connected through a ninth rotating shaft RS9.

FIGS. 5-9 depict the first footrest connector 4 which includes a protrusion 17 fixed thereon and protruding relative to the surface thereof; the fourth footrest connector 7 has a limiting slot 18 provided thereon; the protrusion 17 can move back and forth in the limiting slot 18. The fourth footrest connector 7 can move along with the movement of the first footrest connector 4, so that the fourth footrest connector 7 will not disengage from the first footrest connector 4, thus ensuring the mutual movement between the inner footrest mounting member 10 and the outer footrest mounting member 9.

FIGS. 6-10 depict the middle footrest mounting member 8 which includes thereon a first fixing portion 55 perpendicular to the surface thereof; the first fixing portion 55 is provided thereon with three first mounting holes 54*a*, 54*b* and 54*c* in an elongated shape, where, two of these three first mounting holes 54*a* and 54*c* are transversely arranged, and one of these three first mounting holes 54*b* is vertically arranged; the middle footrest 13 is provided thereon with three first connecting holes corresponding to the first mounting holes 54*a*, 54*b* and 54*c*; the first mounting hole 54*a* and the corresponding first connecting hole are connected through a first bolt in them.

Figure 6:
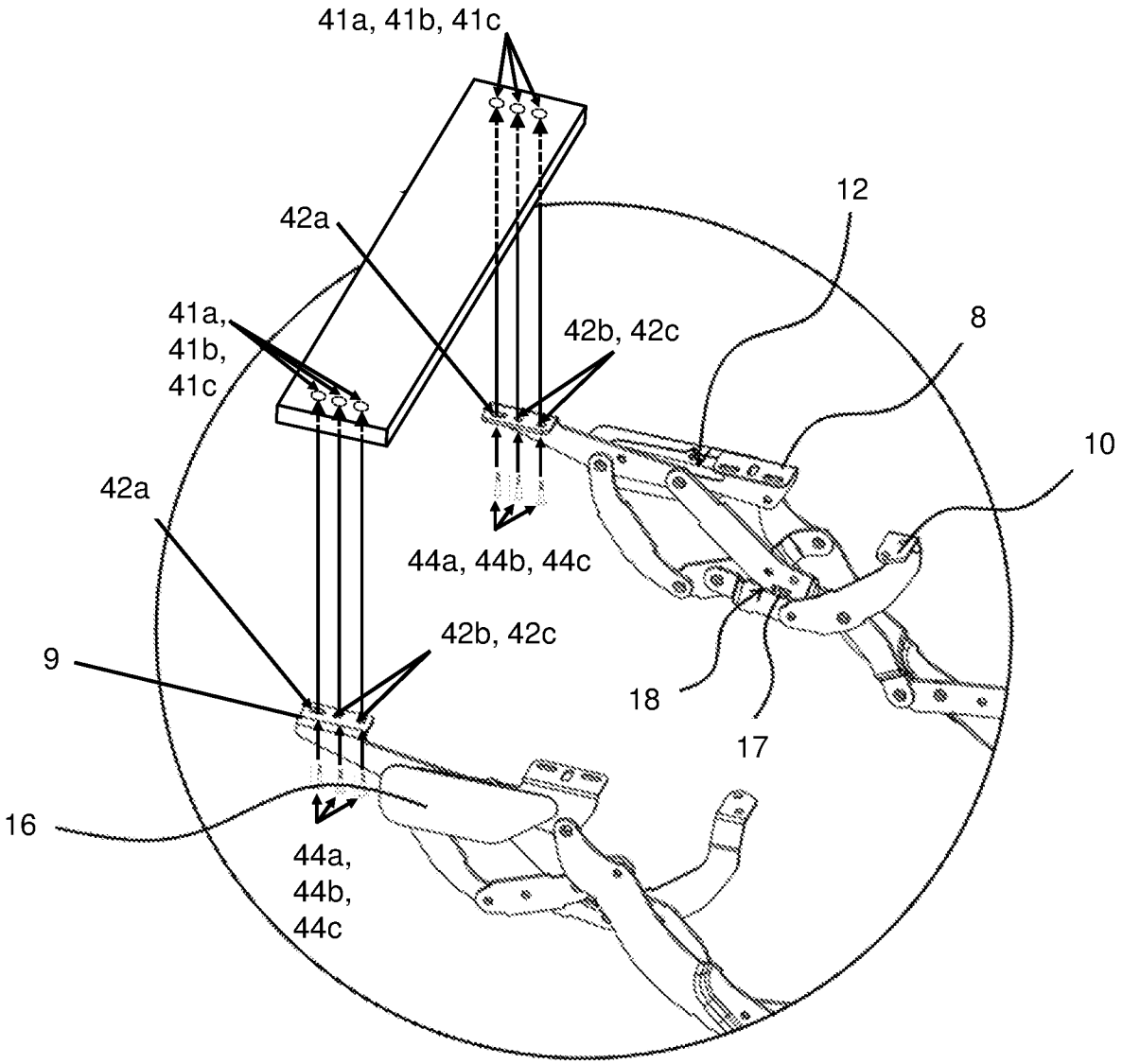
FIG. 6 is an enlarged, partially exploded perspective view of a portion of the stretching device of FIG. 1.
Figure 7:
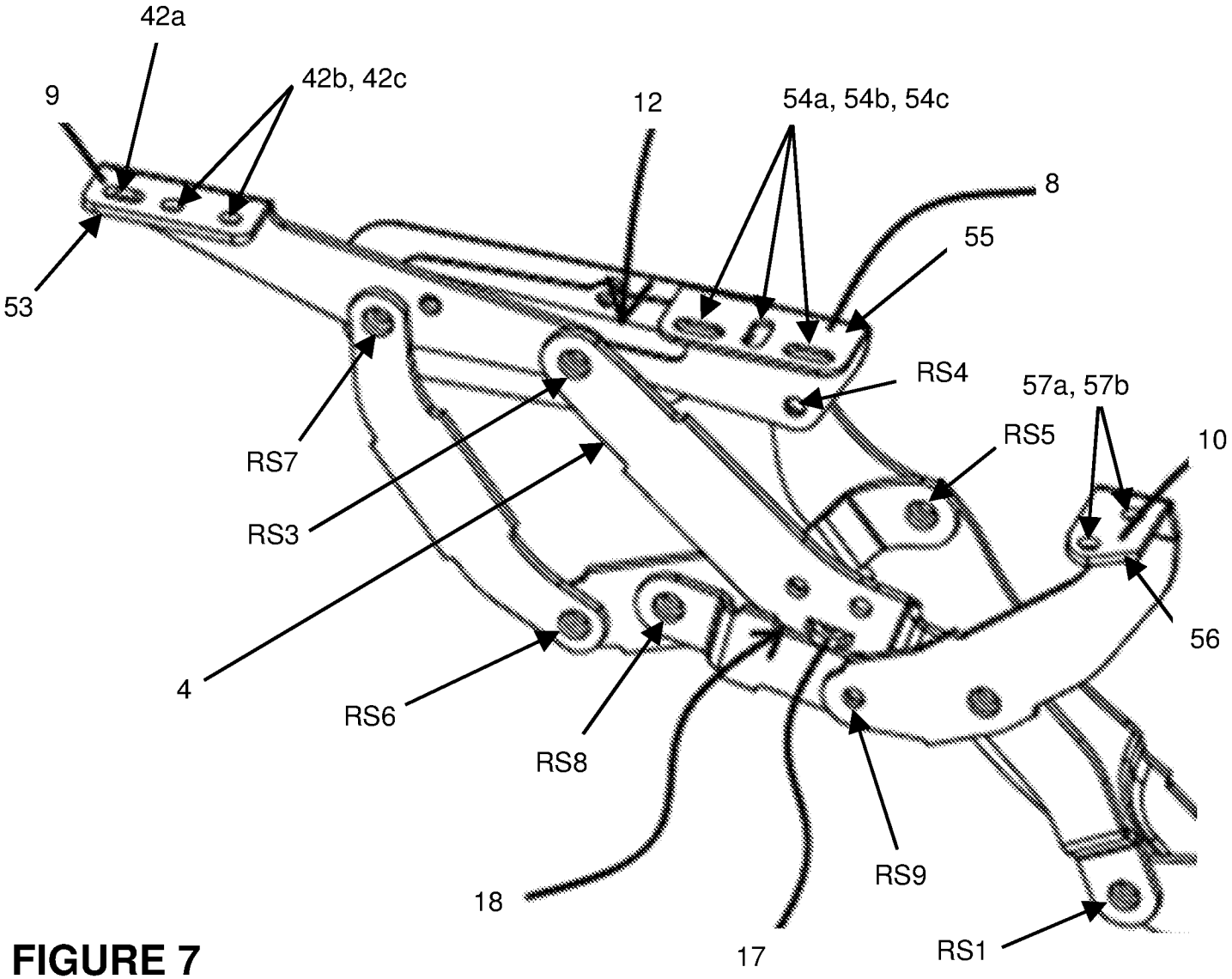
FIG. 7 is an enlarged perspective view of a portion of the stretching device of FIG. 1.
Figure 8:
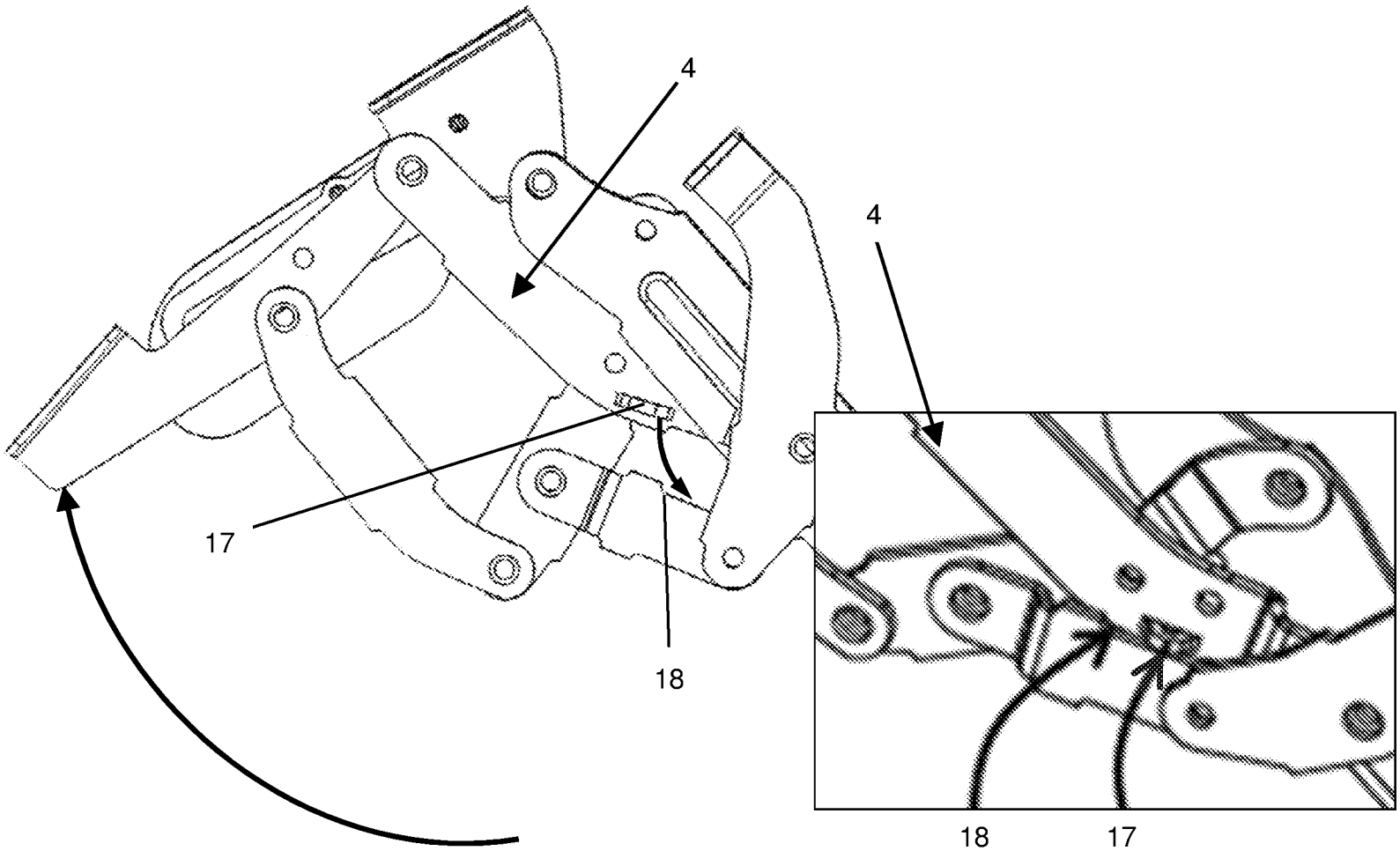
FIG. 8 is a left side view of the middle footrest mounting member of the stretching device of FIG. 1, the left side view including an enlarged portion illustrating a protrusion of a foot rest connector bearing against a limiting slot.
Figure 9:
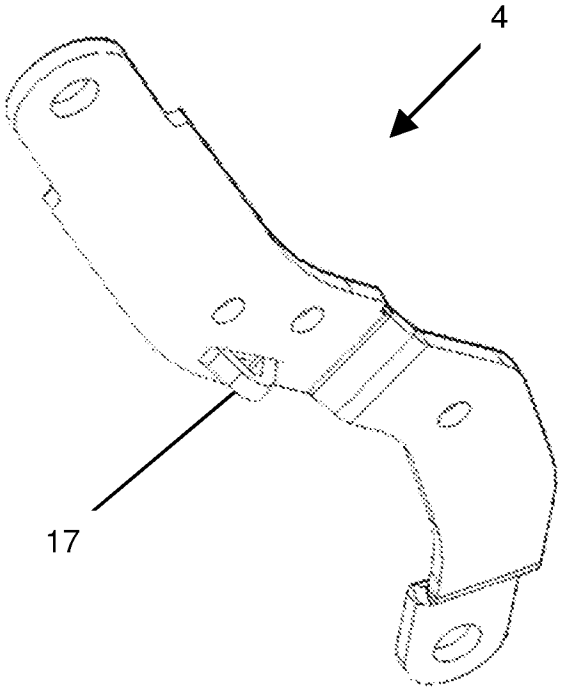
FIG. 9 is a perspective view of the foot rest connector of FIG. 7, illustrating the position of the protrusion of the first footrest connector.
Figure 10:
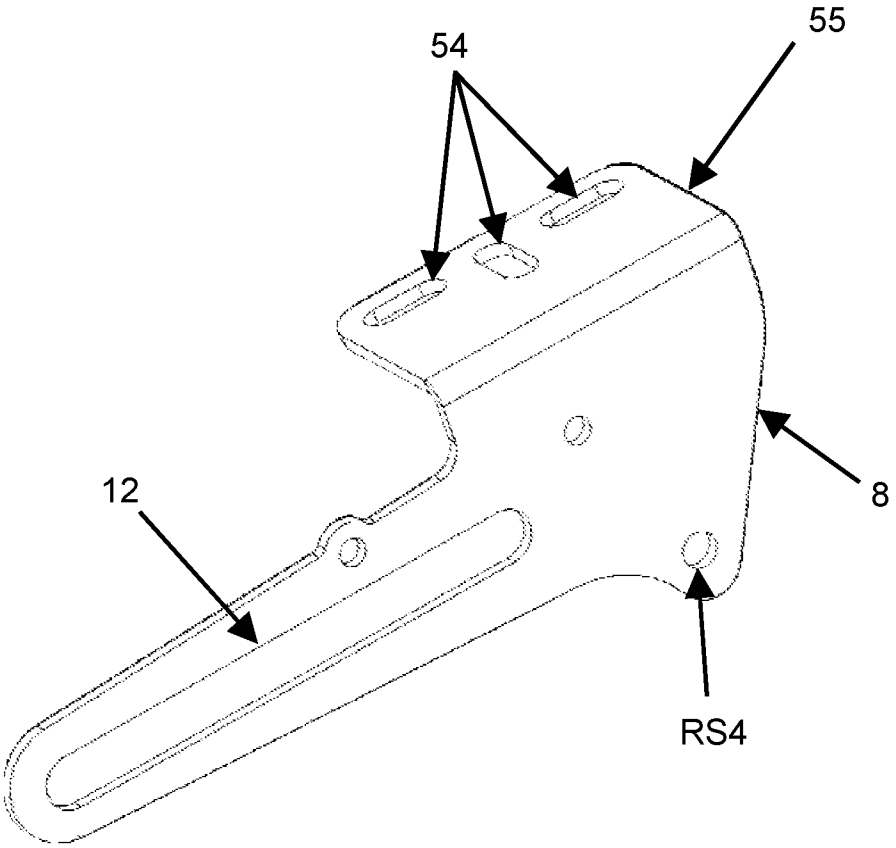
FIG. 10 is a perspective view of the middle footrest mounting member.

The outer footrest mounting member 9, as depicted in FIGS. 6-7, has thereon a second fixing portion 53 perpendicular to the surface thereof; the second fixing portion 53 is provided thereon with one second mounting hole 42*a* in an elongated shape and two third mounting holes 42*b* and 42*c* in a circular shape; the outer footrest 14 is provided thereon with one second connecting hole 41*a* corresponding to the second mounting hole 42*a* and two third connecting holes 41*b* and 41*c* corresponding to the third mounting holes 42*b* and 42*c*; the second mounting hole 42*a* and the corresponding second connecting hole 41*b* are connected through a second bolt 44*b* in them; the third mounting hole 42*c* and the corresponding third connecting hole 42*c* are connected through a third bolt 44*c* in them.

The inner footrest mounting member 10 has thereon a fourth fixing portion 56 perpendicular to the surface thereof; the fourth fixing portion 56 is provided thereon with two fourth mounting holes 57 in a circular shape; the inner footrest 15 is provided thereon with two fourth connecting holes corresponding to the fourth mounting holes 57; the fourth mounting hole 57 and the corresponding fourth connecting hole are connected through a fourth bolt in them.

In the footrest stretching device for a convertible sofa provided by the present invention, the footrest includes three plates: The middle footrest 13, the inner footrest 15 and the outer footrest 14. Under the action of an external force, the third foot lever 2 and the fourth foot lever 3 rotate, and correspondingly, the first footrest connector 4 and the second footrest connector start their motion; under the action of the third footrest connector 6 and the footrest support member 11, the outer footrest mounting member 9 and the middle footrest mounting member 8 are separated from each other, so that the middle footrest 13 and the outer footrest 14 move relative to each other and thus are separated; in the meantime, under the action of the third footrest connector 6 and the fourth footrest connector 7, the inner footrest mounting member 10 and the middle footrest mounting member 8 are separated from each other, so that the middle footrest 13 and the inner footrest 15 move relative to each other and thus are separated; the middle footrest 13, the outer footrest 14 and the inner footrest 15 are separated, thus making the footrest area x of the sofa become larger, thereby facilitating a user resting his feet.

The specific embodiments described herein are merely illustrative of the spirit of the present invention. A person skilled in the art may make various modifications or additions to the specific embodiments described or substitute them in a similar manner, without departing from the spirit of the present invention or beyond the scope defined by the appended claims.

Although many terms are used herein, such as 1. mounting side-plate; 2. third foot lever; 3. fourth foot lever; 4. first footrest connector; 5. second footrest connector; 6. third footrest connector; 7. fourth footrest connector; 8. middle footrest mounting member; 9. outer footrest mounting member; 10. inner footrest mounting member; 11. footrest support member; 12. sliding slot; 13. middle footrest; 14. outer footrest; 15. inner footrest; 16. footrest protector; 17. protrusion; 18. limit slot, etc.; the possibility of using other terms is not excluded. The use of these terms is merely for convenience of describing and explaining the essence of the present invention; it is contrary to the spirit of the present invention to interpret them as any kind of additional limitations.

What is claimed is:

1. A footrest stretching device for a convertible sofa, comprising a left-side component and a right-side component, the left-side component and the right-side component being fixedly connected by a fixing member and each provided with identical parts as follows: a mounting side-plate, a third foot lever and a fourth foot lever, with one end of the third foot lever and one end of the fourth foot lever being rotatably connected to the mounting side-plate; the footrest stretching device including a first footrest connector connected to the other end of the third foot lever, and a second footrest connector connected to the other end of the fourth foot lever; wherein, an outer footrest mounting member is connected to the other end of the first footrest connector; a middle footrest mounting member is connected to the other end of the second footrest connector; a third footrest connector is rotatably connected onto the second footrest connector; the other end of the third footrest connector is rotatably connected to the outer footrest mounting member by a footrest support member; a fourth footrest connector is connected onto the third footrest connector; an inner footrest mounting member is rotatably connected to the other end of the fourth footrest connector; said middle footrest mounting member provided with a sliding slot; said outer footrest mounting member has a sliding post fixed thereon; the sliding post disposed in the sliding slot and being slidable along the sliding slot; a middle footrest is detachably connected onto said middle footrest mounting member; an inner footrest being detachably connected onto said inner footrest mounting member; an outer footrest being detachably connected onto said outer footrest mounting member.

2. The footrest stretching device for a convertible sofa according to claim 1, the other end of the third foot lever and the first footrest connector being rotatably connected through a first rotating shaft; the other end of the fourth foot lever and the second footrest connector being rotatably connected through a second rotating shaft; the other end of the first footrest connector and the outer footrest mounting member being rotatably connected through a third rotating shaft; the other end of the second footrest connector and the middle footrest mounting member being rotatably connected through a fourth rotating shaft; the second footrest connector and one end of the third footrest connector being rotatably connected through a fifth rotating shaft; the other end of the third footrest connector and one end of the footrest support member being rotatably connected through a sixth rotating shaft; the other end of the footrest support member and the outer footrest mounting member being rotatably connected through a seventh rotating shaft; an intermediate portion of the third footrest connector and one end of the fourth footrest connector being rotatably connected through an eighth rotating shaft; and the other end of the fourth footrest connector and the inner footrest mounting member being rotatably connected through a ninth rotating shaft.

3. The footrest stretching device for a convertible sofa according to claim 2, the first footrest connector having a protrusion fixed thereon and protruding relative to the surface thereof; the fourth footrest connector having a limiting slot provided thereon; the protrusion movable back and forth in the limiting slot.

4. The footrest stretching device for a convertible sofa according to claim 3, further comprising a footrest protector is detachably fixed onto the middle footrest mounting member.

5. The footrest stretching device for a convertible sofa according to claim 4, wherein the footrest protector is made of a plastic material.

6. The footrest stretching device for a convertible sofa according to claim 1, the middle footrest mounting member having thereon a first fixing portion perpendicular to the surface thereof; the first fixing portion having a plurality of elongate first mounting holes; the middle footrest having a plurality of first connecting holes corresponding to the first mounting holes; the first mounting hole and the corresponding first connecting hole being connected by a first bolt therethrough.

7. The footrest stretching device for a convertible sofa according to claim 1, the outer footrest mounting member having thereon a second fixing portion perpendicular to the surface thereof; the second fixing portion having a plurality of elongate second mounting holes and round third mounting holes; the outer footrest having a plurality of second connecting holes corresponding to the second mounting holes and third connecting holes corresponding to the third mounting holes; the second mounting hole and the corresponding second connecting hole being connected by a second bolt therethrough; the third mounting hole and the corresponding third connecting hole being connected by a third bolt therethrough.

8. The footrest stretching device for a convertible sofa according to claim 1, the inner footrest mounting member having thereon a fourth fixing portion perpendicular to the surface thereof; the fourth fixing portion having a plurality of round fourth mounting holes; the inner footrest having a plurality of fourth connecting holes corresponding to the fourth mounting holes; the fourth mounting hole and the corresponding fourth connecting hole being connected by a fourth bolt therethrough.

* * * * *